United States Patent [19]

Facchini et al.

[11] 4,162,485

[45] Jul. 24, 1979

[54] FIRE PROTECTION APPARATUS

[75] Inventors: Enio Facchini, Framingham; Carl I. Swanson, Boylston, both of Mass.

[73] Assignee: Walter Kidde and Company, Inc., Clifton, N.J.

[21] Appl. No.: 757,615

[22] Filed: Jan. 7, 1977

Related U.S. Application Data

[62] Division of Ser. No. 595,626, Jul. 14, 1975, Pat. No. 4,017,844.

[51] Int. Cl.[2] ..... G08B 25/00

[52] U.S. Cl. ..... 340/289; 340/287; 340/303

[58] Field of Search ..... 169/61; 340/287, 289, 340/303, 418

[56] References Cited

U.S. PATENT DOCUMENTS

| | | | |
|---|---|---|---|
| 2,189,147 | 2/1940 | Mathisen | 169/61 |
| 2,547,016 | 4/1951 | Kirkpatrick | 340/287 |
| 3,183,501 | 5/1965 | Seaton | 340/303 |
| 3,825,766 | 7/1973 | Connor | 340/289 |
| 3,859,565 | 1/1975 | Henningsen | 340/418 |

*Primary Examiner*—Harold I. Pitts
*Attorney, Agent, or Firm*—John E. Toupal

[57] ABSTRACT

A multi-zone fire protection system in which each protected zone is provided with a detector for producing an alarm signal in response to the presence of combustion products, a source of fire extinguishing agent, and a pull box station manually operable to induce discharge of the extinguishing agent into the protected zone. Each pull station possesses a signal lamp that can be energized to signal an abnormal condition to personnel present in the area. A signal lamp in a given zone is energized via a central control panel in response to an alarm signal from a detector associated with that zone, thereby clearly indicating to personnel at hand the specific zone in which a fire has been detected.

7 Claims, 3 Drawing Figures

FIRE PROTECTION APPARATUS

CROSS-REFERENCE TO RELATED APPLICATION

This application is a division of our co-pending U.S. application, Ser. No. 595,626 filed July 14, 1975, and now U.S. Pat. No. 4,017,844, issued Apr. 12, 1977.

BACKGROUND OF THE INVENTION

This invention relates generally to a fire protection apparatus and, more particularly, to a multi-zone protection system having a central control panel for both controlling and monitoring system operation and individual detectors and manual pull stations for, respectively, detecting a fire condition and initiating extinguishing agent release in each zone.

Present fire alarm and extinguishing systems provide in various ways for the release of extinguishing agent. For example, in certain applications, the extinguishing agent may be automatically released immediately in response to the detection of a fire condition. In other applications, the release of extinguishing agent may be time delayed for a certain period after a pre-extinguish or pre-release alarm signal has been established. Finally, agent release may be initiated by manual action subsequent to an initial alarm signal produced in response to the detection of a fire condition.

The present invention relates primarily to the latter two applications wherein a manual pull station customarily is provided for each zone of a multi-zone protection system. Prior systems of this type have not offered the versatility required for maximum fire protection. For example, it is often desirable that a reserve quantity of extinguishing agent be released some time after the initial release of a main quantity of agent. Heretofore, the release of a reserve quantity of an extinguishing agent has been accomplished only by action taken at a central control panel while in many instances it would be desirable that the release of the reserve agent be initiated by action at a pull station in the immediate vicinity of the zone in which the fire condition exists. This would facilitate appropriate action by personnel actually observing the fire condition. Another drawback of existing systems is that personnel are not always able to quickly identify the particular manual pull station associated with a zone in which a fire has been detected.

The object of this invention, therefore, is to provide an improved, multi-zone fire protection system employing an individual detector and an extinguishing agent releasing pull station for each protected zone.

SUMMARY OF THE INVENTION

The present invention consists of a multi-zone fire protection system in which each protected zone is provided with a detector for producing an alarm signal in response to the presence of combustion products, a source of fire extinguishing agent, and a pull box station manually operable to induce discharge of the extinguishing agent into the protected zone. Each pull station possesses a signal lamp that can be energized to signal an abnormal condition to personnel present in the area. A signal lamp in a given zone is energized via a central control panel in response to an alarm signal from a detector associated with that zone, thereby clearly indicating to personnel at hand the specific zone in which a fire has been detected.

In a featured embodiment of the invention, each pull station includes a first electrical switch manually operable to a closed position, a latch for latching the first switch in the closed position, a second electrical switch manually operable to a closed position, restoring means for returning the second switch to an open position after being manually actuated into its closed position, and a mechanical indicator for providing an indication in response to movement of the first switch into its closed position. Preferably, the first and second switches and the mechanical indicator are mechanically coupled so as to be simultaneously operable by a single actuator. Closure of the first switch produces an alert signal at the center control panel indicating that action has been initiated at that particular pull station and a similar indication is provided at the pull station itself by the mechanical indicator. The simultaneous closure of the second switch initiates release of a main quantity of extinguishing agent into the zone associated with the pull station. After initiating release of the main extinguishing agent, the second switch is restored to open position by the restoring mechanism and after appropriate action has been taken at the central control panel can be reclosed to initiate release of a reserve quantity of extinguishing agent.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
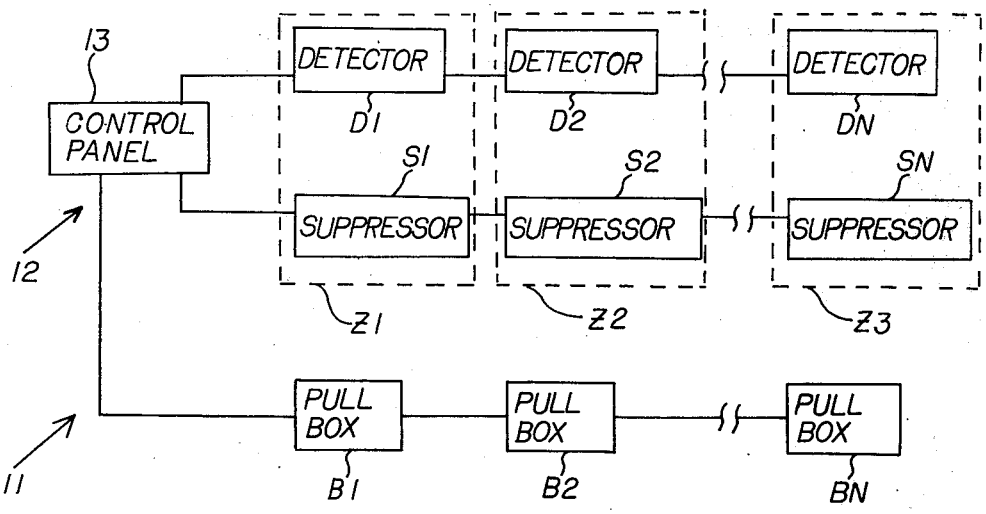
FIG. 1 is a schematic block diagram illustrating a preferred system embodiment of the invention.

Referring now to FIG. 1 there is shown a fire protection system 11 that provides individualized fire protection for a plurality of distinct zones Z1, Z2 . . . ZN. Located in each of the zones is a fire detector D1, D2 . . . DN. The detectors D1–DN can be of any conventional type for detecting products of com-combustion and including, for example, thermal detectors, ionization detectors, optical smoke detectors, etc. Also located in each of the zones Z1–ZN is a fire suppressor S1, S2 . . . SN. The suppressors S1–SN provide a source of fire extinguishing agent and can be individual fire suppressant filled vessels that are electrically actuated to release their suppressant content. Examples of such suppressor units are disclosed in U.S. Pat. Nos. 2,693,240 and 3,523,583. However, the suppressors Z1–ZN can also entail merely individual discharge nozzles connected by suitable piping and valves to a central supply of extinguishing agent (not shown).

Figure 3:
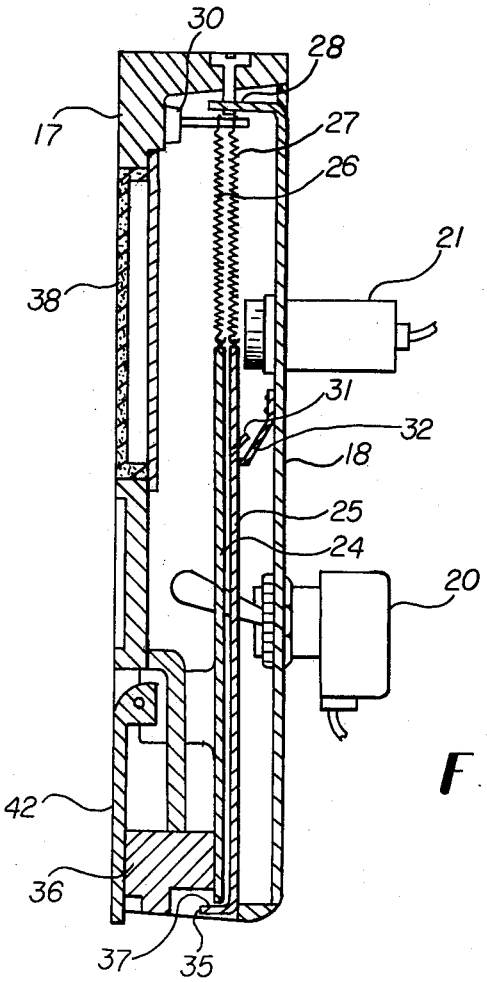
FIG. 3 is a cross-sectional view of the pull station shown in FIG. 2.
Figure 2:
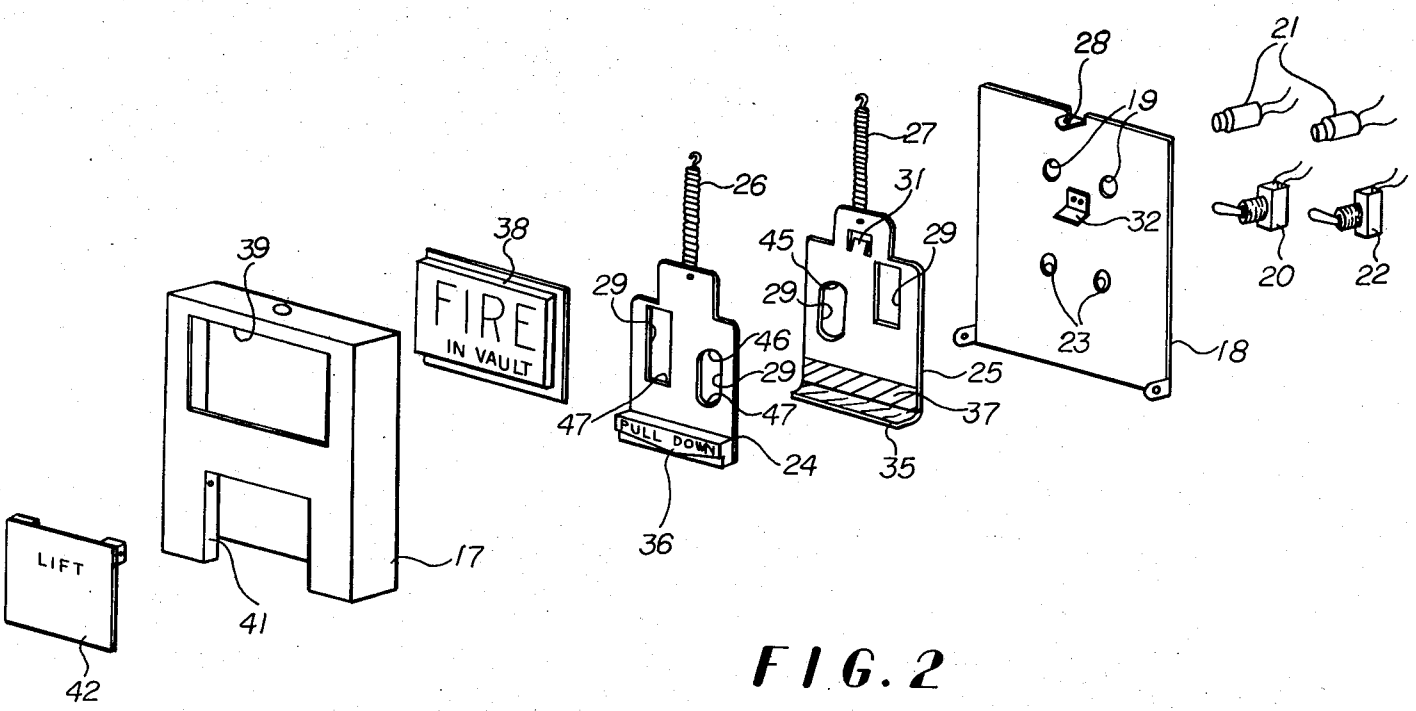
FIG. 2 is an exploded perspective view of a manual pull station utilized in the system of FIG. 1.

Located in the vicinity of each zone Z1–ZN, is a manual pull box station B1, B2 . . . BN. The structural details of the pull boxes B1–BN are shown in FIGS. 2 and 3 and are described in detail hereinafter. Electrically interconnecting the detectors D1–DN, the suppressors S1–SN and the pull boxes B1–BN is a control circuit 12 including a conventional centrally located control panel 13.

Referring now to FIGS. 2 and 3 there is shown one of the pull boxes B1–BN all of which are identical. The box is formed by a housing 17 secured by a screw to a mounting bracket 28 on a backplate 18 suitable for mounting on a support surface (not shown). Extending through upper openings 19 in the backplate 18 are a pair of incandescent lamps 21 while a pair of momentary toggle switches 20 and 22 extend through lower openings 23 therein. Both the incandescent lamps 21 and the switches 20, 22 are electrically connected by the control circuit 12 to the control panel 13 shown in FIG. 1. Located within the housing 17 are a release plate 24 and a latching plate 25 that are supported by springs 26 and 27 from a pin 30 mounted on the housing 17. (FIG. 2) The plates 24 and 25 are fitted with openings 29 that accommodate the toggle switches 20, 22. Also formed on the latching plate 25 is a rearwardly projecting detent 31 that engages a forwardly projecting latching spring 32 on the backplate 18 during operation of the box as described below. A forwardly projecting lip 35 at the bottom edge of the latching plate 25 extends below a handle 36 mounted on the lower front portion of the release plate 24. Inscribed on the lower portion of the latching plate 25 directly above the lip 35 is an indicator flag 37. A translucent window 38 bearing a suitable legend is mounted in an accommodating opening 39 in the housing 37. The legend on the window 28 would typically comprise indicia identifying the particular zone Z1–ZN with which the box is associated. Pivotally attached in a frontal recess 41 in the housing 17 is a lift plate 42 that normally hides the handle 36 on the release plate 24.

During operation of the system 11, a fire condition in any of the zones, Z1–ZN, will be detected by the detector D1–DN located in that zone resulting in the generation of an alarm signal that will be received at the control panel 13. For example, in response to a fire in zone Z1 the detector D1 will supply an alarm signal to the control panel 13 which will in turn supply energizing current to the incandescent lamps 21 in the pull box B1. This energization of the lamps 21 can be either continuous or flashing depending upon the effects desired. The resultant illumination of the window 38 will apprise personnel at hand that a fire condition has been detected in zone Z1 associated with the box B1. The apprised person then can personally examine the conditions existing in zone Z1 and determine whether a release of extinguishing agent is required. If so, he lifts the pull plate 42 and pulls downwardly on the handle 36 forcing both the release plate 24 and the latching plate 25 downwardly against the bias provided by the springs 26 and 27. During this downward movement of the release plate 24 and latching plate 25, the upper edge surfaces 45 and 46 of the openings 19 engage and actuate the toggle switches 20 and 22 into closed positions. The closure of the first switch 20 provides a signal at the control panel 13 indicating that such action has occurred at pull box B1. Closure of the second switch 22 provides a signal through the control panel 13 that induces release of extinguishing agent from the suppressor S1 in the zone Z1.

After the handle 36 is released, the release plate 24 is pulled upwardly by the spring 26 causing the lower edge surface 47 of the opening 19 to reopen the second switch 22. The operator can then re-examine the conditions existing in the zone Z1 and determine whether the release of a reserve quantity of extinguishing agent is required. If so, the handle 36 can again be pulled downwardly to re-close the second switch 22 and provide a signal at the control panel 13 resulting in the release of a reserve quantity of extinguishing agent into the zone Z1. Generally, this release of a reserve agent will be possible only after precautionary resetting actions have taken place at the control panel 13. With the initial pulling of the handle 36, however, the latching detent 31 on the latch plate 25 passes under the latching spring 32 on the back plate 18 to thereby retain the latching plate 25 in the downward position and prevent its upward movement after release of the handle 36. Thus the first switch 20 remains closed providing a continuous indication at the control panel 13 that the initial action has been taken at the control box B1. Similarly at the control box B1 itself, with the latching plate 25 retained in its down position, the indicator flag 37 extends below the housing 17 providing a continuous indication that an initial quantity of suppressant has been released. Withdrawal of the indicator flag 37 and closure of the switch 20 can be accomplished only by opening the housing 17 and manually disengaging the detent 31 and spring latch 32.

Obviously, many modifications and variations of the present invention are possible in light of the above teachings. For example, more than one pull box can be used with each protected zone and the boxes can be positioned within the zone as well as in the vicinity thereof. It is therefore, to be understood that within the scope of the appended claims the invention can be practised otherwise than as specifically described.

What is claimed is:

1. A fire control system comprising:

a plurality of detectors, each located in a different zone so as to provide an alarm signal in response to the presence of combustion products therein;

extinguishing means for selectively discharging a fire extinguishing agent into any of said different zones;

a plurality of manual pull stations, one located in the immediate vicinity of and associated with each of said zones and manually operable to induce discharge thereinto of said extinguishing agent from said extinguishing means; each of said pull stations comprising signal means energizable to provide a visual indication of an abnormal condition, a box for mounting on a support surface, a first electrical switch mounted in said box and manually operable from an open to a closed position, latch means for latching said first switch in said closed position, a second electrical switch mounted in said box and manually operable from an open to a closed position so as to provide an initiation signal for initiating release of said extinguishing agent into an associated zone, restoring means for returning said second switch to said open position after being manually actuated into said closed position, and mechanical indicator means for providing a visual indication in response to movement of said first switch into said closed position; and control circuit means connecting said detectors in each zone with said pull station associated with that zone, said control circuit means energizing said signal means in a given pull station in response to an alarm signal from an associated detector and comprising a control panel interconnected between all of said detectors, said extinguishing means, and all of said pull stations, said control panel providing an alert signal in response to operation of one of said first electrical switches to a closed position.

2. Apparatus according to claim 1 including manual actuator means for simultaneously actuating both said first and second switches into said closed position.

3. Apparatus according to claim 2 wherein said indicator means is coupled to said manual actuator so as to be actuated thereby.

4. Apparatus according to claim 3 wherein said indicator means comprises a flag portion manually concealed by said box and moved into an exposed position in response to closing of said first and second switches.

5. Apparatus according to claim 4 wherein said flag portion is retained in said exposed position by said latch means.

6. Apparatus according to claim 5 wherein said signal means comprises removable indicia means illustrating the function of said box.

7. Apparatus according to claim 7 wherein said indicia means comprises a window, and said signal means further comprises electrical lamp means for illuminating said window and energized in response to said alarm signal from an associated detector.

* * * * *